US012397981B2

(12) United States Patent
Forsberg

(10) Patent No.: US 12,397,981 B2
(45) Date of Patent: Aug. 26, 2025

(54) SYSTEM FOR TRANSPORTING HOT FOOD

(71) Applicant: Paul J. Forsberg, Naples, FL (US)

(72) Inventor: Paul J. Forsberg, Naples, FL (US)

( * ) Notice: Subject to any disclaimer, the term of this patent is extended or adjusted under 35 U.S.C. 154(b) by 21 days.

(21) Appl. No.: 18/442,308

(22) Filed: Feb. 15, 2024

(65) Prior Publication Data

US 2024/0182229 A1 Jun. 6, 2024

Related U.S. Application Data

(63) Continuation-in-part of application No. 18/179,754, filed on Mar. 7, 2023, now Pat. No. 12,252,326, which is a continuation-in-part of application No. 17/857,798, filed on Jul. 5, 2022, now Pat. No. 11,952,182, which is a continuation-in-part of application No. 17/154,592, filed on Jan. 21, 2021, now abandoned.

(60) Provisional application No. 62/963,946, filed on Jan. 21, 2020.

(51) Int. Cl.
*B65D 81/38* (2006.01)
*B65D 81/26* (2006.01)
*B65D 85/36* (2006.01)

(52) U.S. Cl.
CPC ..... *B65D 81/3897* (2013.01); *B65D 81/264* (2013.01); *B65D 85/36* (2013.01); *B65D 2203/12* (2013.01); *B65D 2585/366* (2013.01)

(58) Field of Classification Search
CPC .. B65D 81/3897; B65D 81/264; B65D 81/36; B65D 2203/12; B65D 2585/366
USPC ..... 220/592.2; 229/87.07, 87.08, 87.09, 229/87.11, 103.2; 426/113, 124, 109; 206/524.3
See application file for complete search history.

(56) References Cited

U.S. PATENT DOCUMENTS 4,754,914 A * 7/1988 Wischusen, III ..... B65D 75/14 229/87.08
4,961,944 A * 10/1990 Matoba ..... A47J 36/022 426/118
5,045,330 A * 9/1991 Pawlowski ..... B65D 81/3453 426/243
5,631,052 A * 5/1997 Andersen ..... B28B 13/021 428/312.4
7,284,687 B1 * 10/2007 Minidis ..... B65D 85/36 229/87.08
9,994,354 B2 * 6/2018 Volpis ..... B65D 85/36
2011/0240722 A1 * 10/2011 Stromme ..... B65D 65/06 229/87.08

* cited by examiner

*Primary Examiner* — Rafael A Ortiz
(74) *Attorney, Agent, or Firm* — Mark Terry

(57) ABSTRACT

A system for addition to a box for transporting hot food includes a sheet of paper having a length and width greater than the length and width of an interior of the box, the sheet including four folds defining a diamond shape, each fold configured to be folded towards a center of the sheet, such that when food is placed on the sheet, the sheet is folded according to the four folds defined in the sheet, and the sheet is placed within the interior of the box, the sheet completely covers the food and the sheet fits securely within the interior of the box, two food-safe coatings on the sheet, orifices in the sheet for allowing moisture to escape therethrough, and, wherein the sheet is configured for being removably positioned within the interior of the box, such that the food rests on the sheet.

20 Claims, 15 Drawing Sheets

PRIOR ART

SYSTEM FOR TRANSPORTING HOT FOOD

CROSS-REFERENCE TO RELATED APPLICATIONS

This patent application is a continuation in part of patent application Ser. No. 18/179,754 filed Mar. 7, 2023, and titled System for Transporting Hot Food, which is a continuation in part of patent application Ser. No. 17/857,798 filed Jul. 5, 2022, and titled System for Transporting Hot Food, which is a continuation in part of patent application Ser. No. 17/154,592 filed Jan. 21, 2021, and titled System for Transporting Hot Food, which claims the benefit of provisional patent application No. 62/963,946 filed Jan. 21, 2020, and titled System for Transporting Hot Food. The subject matter of patent application Ser. Nos. 18/179,754, 17/857,798, 17/154,592 and 62/963,946 are hereby incorporated by reference in their entirety.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The disclosed embodiments relate to the field of food containers, and more specifically to the field of boxes to transport hot foods from a source location to a predefined destination.

BACKGROUND

Containers to deliver freshly baked pizzas have existed at least since the 19th century, when Neapolitan pizza bakers put their products in multi-layered metallic containers and then sent them to the street sellers. The aerated container was round and made of tin or copper. Disposable packaging started to be developed in the United States, after the Second World War. At that time pizza was becoming increasingly popular and the first pizza delivery services were created. In the beginning they attempted to deliver pizzas in simple cardboard boxes, similar to those used in cake shops, but these often became wet, bent, or even broke in two. Other pizza chefs tried to put pizzas on plates and transport them inside paper bags. This partly solved the problem. However, it was almost impossible to transport more than a single pizza inside one bag. The first patent for a pizza box made of corrugated cardboard was applied in 1963 and displayed the characteristics of today's pizza packaging: plane blanks, foldability without need of adhesive, stackability and ventilation slots.

Nearly 60 years later, the pizza box design has not evolved much beyond the standard cardboard square. In fact, the pizza box remains a balancing act in proportions, which endeavors to retain just the right amount of heat to keep its contents warm and release the right amount of steam. On the one hand, if the pizza is completely sealed inside the pizza box, the steam released from the pizza will condense and create a soggy crust. On the other hand, if the pizza box has too much ventilation, the pizza will cool. Unfortunately, because the requirements between usability and functionality are often conflicting in nature, it is difficult to find a pizza box encompassing the above-mentioned elements without compromise. As a result, there exists a need for improvements over the prior art and more particularly, for a box that keeps its food contents fresh, crisp, and hot for an extended period of time.

SUMMARY

A system for addition to a box for transporting hot food is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for addition to a box for transporting hot food is disclosed. The system includes a sheet of paper having a length equal to about one and a half times the length of an interior of the box, and the sheet of paper having a width equal to about one and a half times the width of the interior of the box, the sheet further including four folds defining a diamond shape in the sheet, wherein each of the four folds defines a corresponding flap being a portion of the sheet configured to be folded towards a center of the sheet, such that when food is placed on the sheet, the sheet is folded according to the four folds defined in the sheet, and the sheet is placed within the interior of the box, the sheet completely covers the food and the sheet fits securely within the interior of the box, a first food-safe coating on the sheet, wherein said first coating has heat reflecting characteristics, a second food-safe coating on the sheet, wherein said second coating has oil-resistant characteristics and heat reflecting characteristics, a plurality of orifices in the sheet, the plurality of orifices configured for allowing moisture to escape therethrough, and, wherein the sheet is configured for being removably positioned within the interior of the box, such that the food rests on the sheet.

In another embodiment, a system for transporting hot food includes a box, and a sheet of paper having a length equal to about one and a half times the length of an interior of the box, and the sheet of paper having a width equal to about one and a half times the width of the interior of the box, the sheet further including four folds defining a diamond shape in the sheet, wherein each of the four folds defines a corresponding flap being a portion of the sheet configured to be folded towards a center of the sheet, such that when food is placed on the sheet, the sheet is folded according to the four folds defined in the sheet, and the sheet is placed within the interior of the box, the sheet completely covers the food and the sheet fits securely within the interior of the box, a first food-safe coating on the sheet, wherein said first coating has heat reflecting characteristics, a second food-safe coating on the sheet, wherein said second coating has oil-resistant characteristics and heat reflecting characteristics, a plurality of orifices in the sheet, the plurality of orifices configured for allowing moisture to escape therethrough, and, wherein the sheet is configured for being removably positioned within the interior of the box, such that the food rests on the sheet.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate the claimed embodiments and together with the description, serve to explain the principles of the disclosed embodiments. The embodiments illustrated herein are presently preferred, it being understood, however, that the claimed embodiments are not limited to the precise arrangements and instrumentalities shown, wherein:

DETAILED DESCRIPTION

Figure 1:
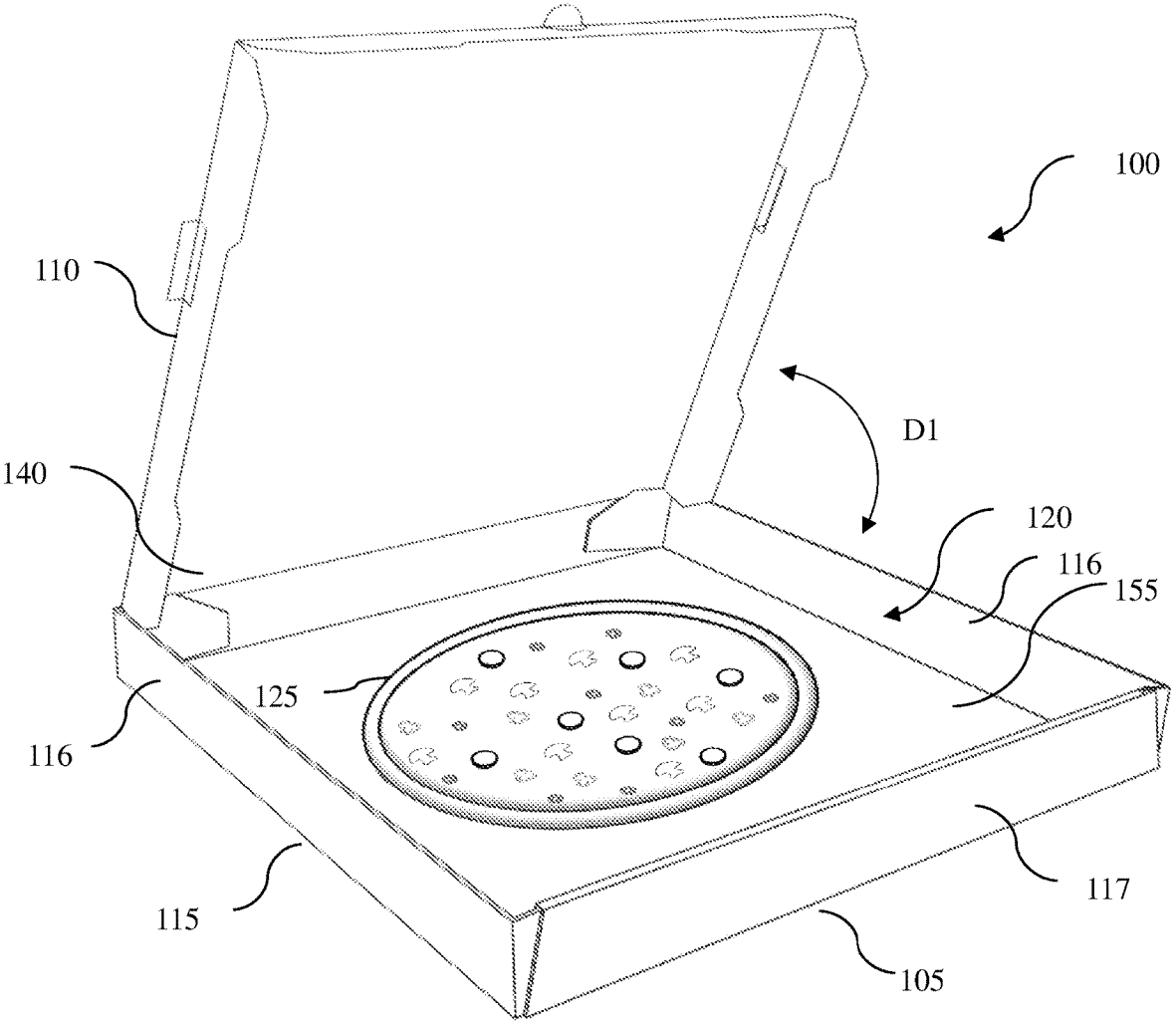
FIG. 1 is a front perspective view of a prior art system for transporting hot food.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The claimed embodiments represent a significant advancement over previous technologies by introducing a system designed specifically for transporting hot food, ensuring that the food remains fresh, crisp, and hot for durations that were previously unattainable. This innovation addresses a common challenge faced by food delivery services and consumers alike: maintaining the optimal temperature and texture of hot food from the point of preparation to the point of consumption. While the examples herein primarily illustrate the system's application to pizza, a staple in the food delivery industry known for its sensitivity to temperature and humidity changes, it's important to recognize the system's versatility.

Experts in the culinary and food service industries will recognize the potential for these embodiments to revolutionize the delivery of a wide array of hot foods. The system's unique design and materials can be easily adapted to suit various types of cuisine that are traditionally difficult to transport without compromising quality. For instance, burritos, which are often wrapped in foil to retain heat, can benefit from this system by maintaining their warmth without becoming soggy due to trapped steam. Similarly, burgers, which require a delicate balance to keep the bun crispy and the patty juicy, could be delivered in optimal condition, preserving the integrity of each component.

Furthermore, items like French fries and nachos, which are notoriously known for losing their crispness during transport, stand to gain significantly from the system's innovative approach to moisture management and heat retention. The introduction of specialized coatings and strategically placed orifices within the transport material can facilitate the escape of excess moisture, thereby preventing the sogginess that often plagues these foods upon delivery.

In essence, the claimed embodiments extend beyond the realm of pizza delivery, offering a versatile solution to a longstanding problem in the food service industry. By maintaining the desired temperature and texture of a wide range of hot foods, this system enhances the overall dining experience for consumers who opt for delivery or takeout options. The adaptability of the design to accommodate different foods further underscores the inventive step and broad applicability of the claimed embodiments, making it a valuable addition to the art of food transportation.

This elaboration emphasizes the system's innovative features, broad applicability across various types of food, and its potential impact on the food delivery industry.

Referring now to the Figures, FIG. 1 illustrates a prior art system 100 for transporting hot food according to an example embodiment. The system includes a box 105 having a top side 110 and a bottom side 115. The top side 110 of the box defines a first substantial planar surface and the bottom side 115 of the box defines a second substantial planar surface. The bottom side 115 of the box is hingedly attached to the box such that the top side 110 of the box may pivot between an open position and a closed position (in the direction of double arrowed line D1) to allow access to an interior volume 120 of the box 105. The interior volume 120 of the box 105 is formed by two opposing sidewalls 116 and two opposing end walls 117 on the bottom side of the box. The interior volume 120 of the box is configured to provide sufficient area to store at least one food item.

In the present embodiment, the box 105 is generally sized to store a pizza 125, however, it should be appreciated that the box may have other shapes and dimensions to accommodate additional foods, and such variations are within the spirit and scope of the claimed embodiments. The box is preferably comprised from an integral piece of recyclable, non-toxic and food safe paper-based material such as corrugated cardboard or may be similarly comprised of biodegradable or compostable materials such as sugarcane, bamboo, and plant-based materials. The pizza sits on an interior surface 155 of the bottom side 115 of the box 105 and the interior surface 140 of the top side 110 of the box 105 closes onto and on top of the pizza when the box is in the closed position.

Figure 2A:
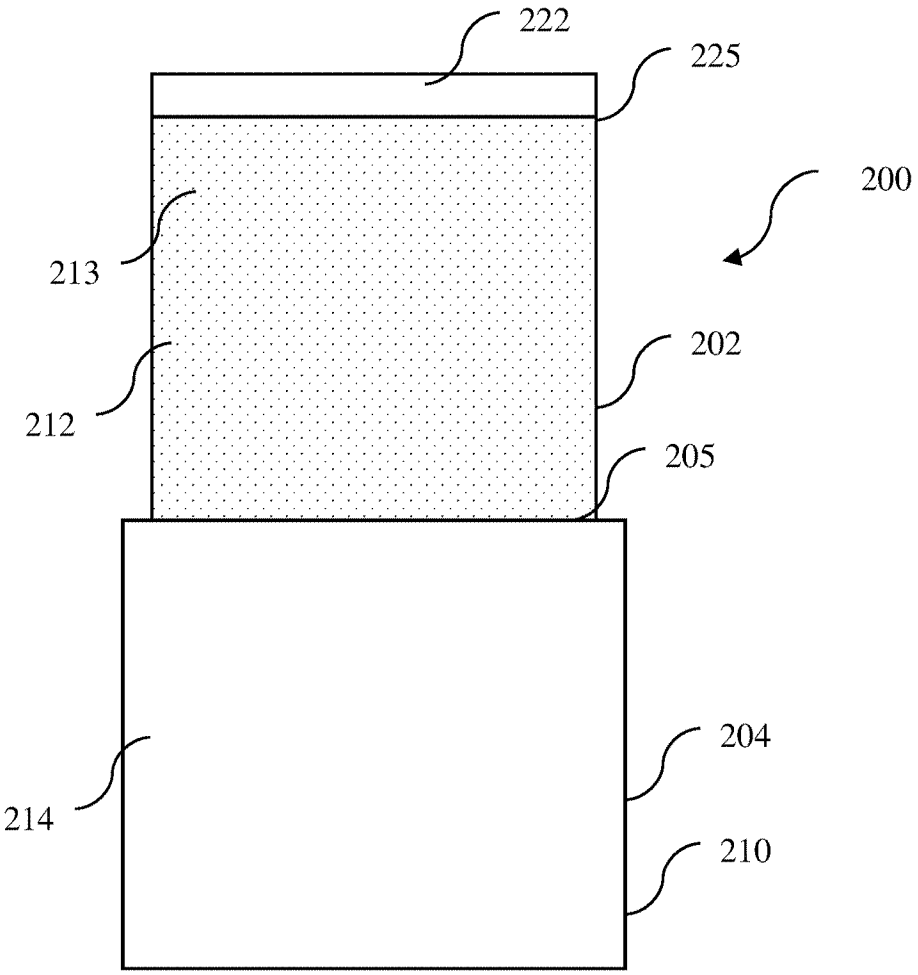
FIG. 2A is a front view of a first embodiment of a system for addition to a box for transporting hot food, shown in a flat orientation, according to an example embodiment.

FIG. 2A is a front view of a first embodiment of an insertable paper system 200 for addition to a box 105 for transporting food, the system comprising a sheet of paper 210 having a single fold 205 at or near a midpoint of the sheet, the single fold defining a top sheet 202 and a bottom sheet 204. The top sheet has a length and a width equal to the length and the width of an interior of the box 105 (such as 18 inches by 18 inches), such that the top sheet 202 fits within the interior of the box without being folded. The bottom sheet 204 having a length and a width that are both at least half an inch longer than the length and the width of the interior of the box 105 (such as 18.5 inches by 18.5 inches), such that when the bottom sheet is placed within the interior of the box, edges of the bottom sheet are configured to extend upwards along sides of the interior of the box. Notice that the length and the width of the bottom sheet are longer than the length and the width of the top sheet.

A first food-safe laminate (or non-laminate) coating is deposited on an interior surface 212 of the top sheet 202, wherein said first coating has heat reflecting characteristics. A second food-safe laminate (or non-laminate) coating is deposited on an interior surface 214 of the bottom sheet 204, wherein said second coating has oil-resistant characteristics. A plurality of orifices 213 are located in the top sheet, the plurality of orifices configured for allowing moisture to escape therethrough. In one embodiment, the plurality of orifices 213 may be slits, holes, perforations, cuts, cutouts, of the like. The insertable paper system 200 is configured for being removably positioned within the interior of the box 105, such that the food rests on the interior surface 214 of the bottom sheet 204. The system is configured to allow steam and moisture to escape to prevent the food or pizza crust from getting soggy.

The food-safe laminate coatings are comprised of impermeable, nonstick material capable of resisting high temperatures, however, it should be appreciated that other impermeable, nonstick materials may be employed provided that they effectively prevent the top of the pizza from adhering to the system 200. It should be appreciated that attachment devices may be used to secure the system 200 to the interior surface 140 of the top side 110 of the box 105, including backing materials coated with natural adhesives made from organic sources such as vegetable starch, natural resins, or animals, clamps, brackets, slots, or any other suitable method known in the art. Note also that the insertable paper system 200 may be removably coupled to an interior surface 155 of the bottom side 115 of the box 105, according to an example embodiment.

The insertable paper system 200 is configured to maintain the freshly prepared pizza 125 warm during transportation. In operation, the system 200 is positioned inside the box 105 such that when the hot pizza is removed from the oven and placed directly on the box, the pizza 125 is elevated off the interior surface of the bottom side of the box by the width of system 200.

FIG. 2A also shows another fold 225 at a top of the top sheet 202, the fold 225 defining a strip 222, which acts as a handle or tab that may be handled by a person wanting to move the device 200. The fold 225 and fold 205 may be perforated folds. The strip may have the same width as the top sheet but have a height (such as ½ to 1 inch) that is much smaller than the top sheet, hence referring to 222 as a strip. The strip may not include the orifices located in the top sheet.

Figure 2B:
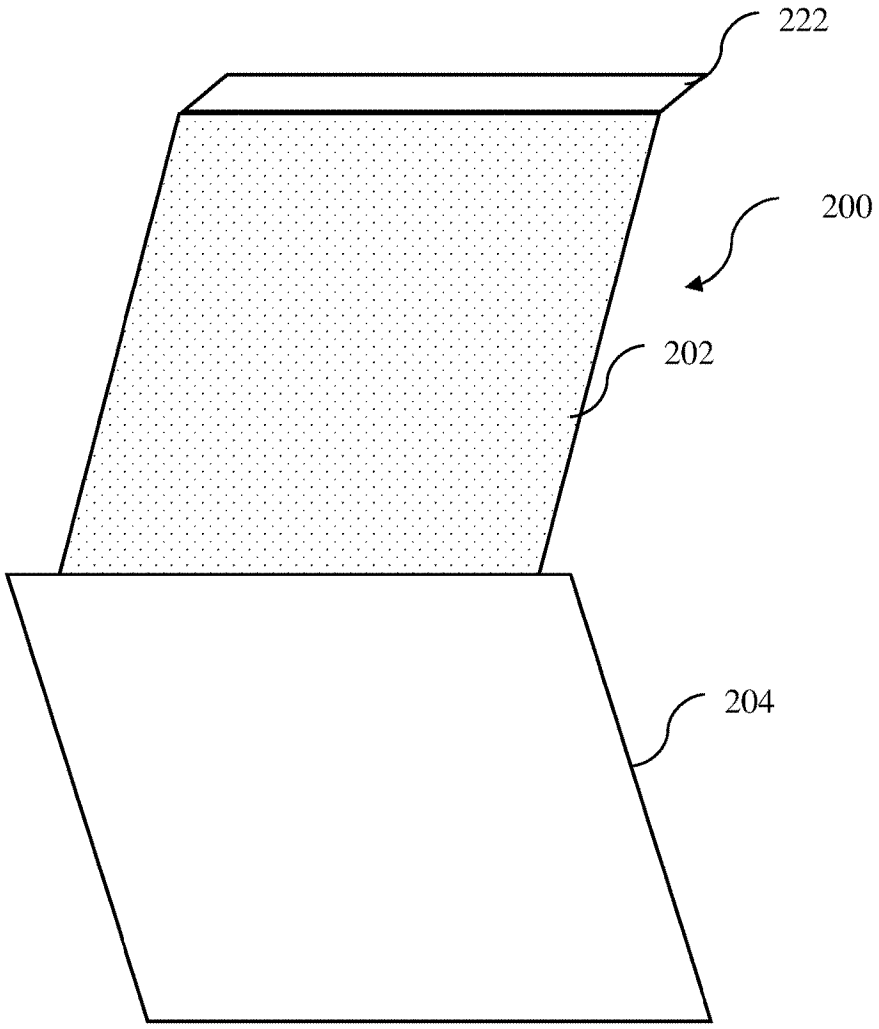
FIG. 2B is a front perspective view of the first embodiment of a system for addition to a box for transporting hot food, shown in a partially folded orientation, according to an example embodiment.

FIG. 2B is a front perspective view of the first embodiment of the insertable paper system 200 for addition to a box for transporting hot food, shown in a partially folded orientation, according to an example embodiment.

Figure 2C:
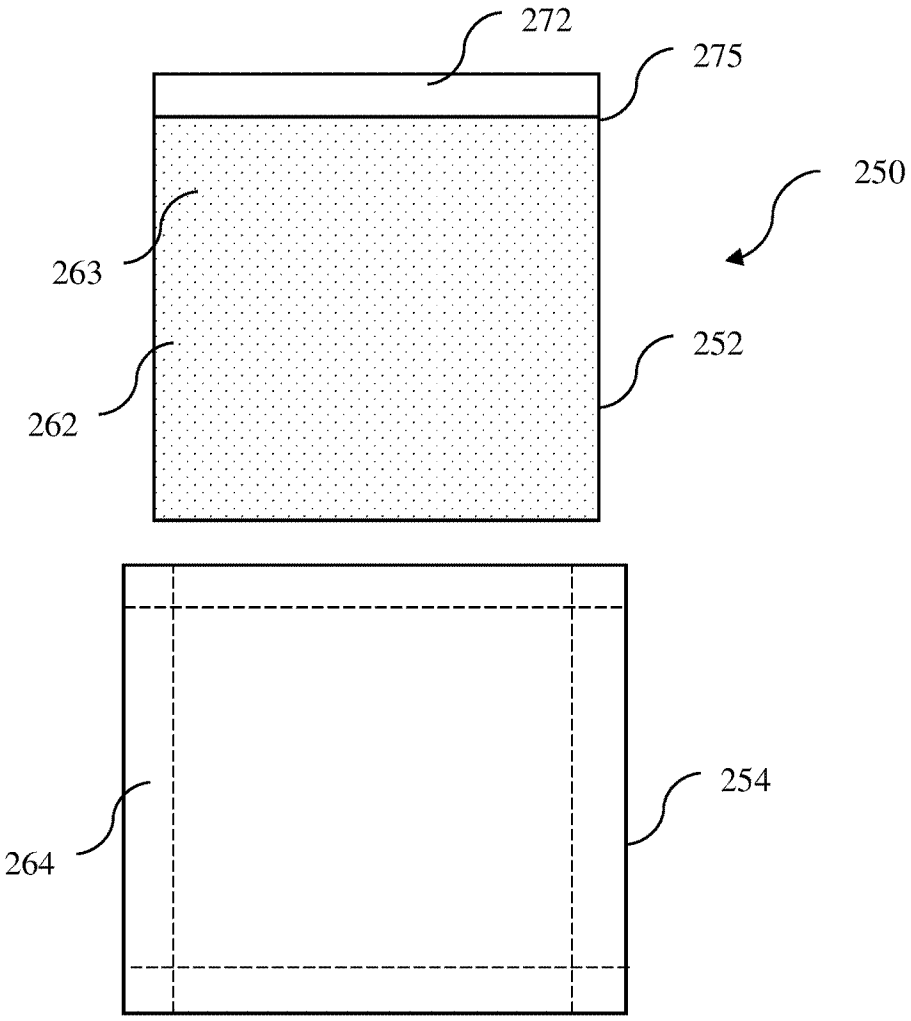
FIG. 2C is a front view of a second embodiment of a system for addition to a box for transporting hot food, shown in a flat orientation, according to an example embodiment.
Figure 2D:
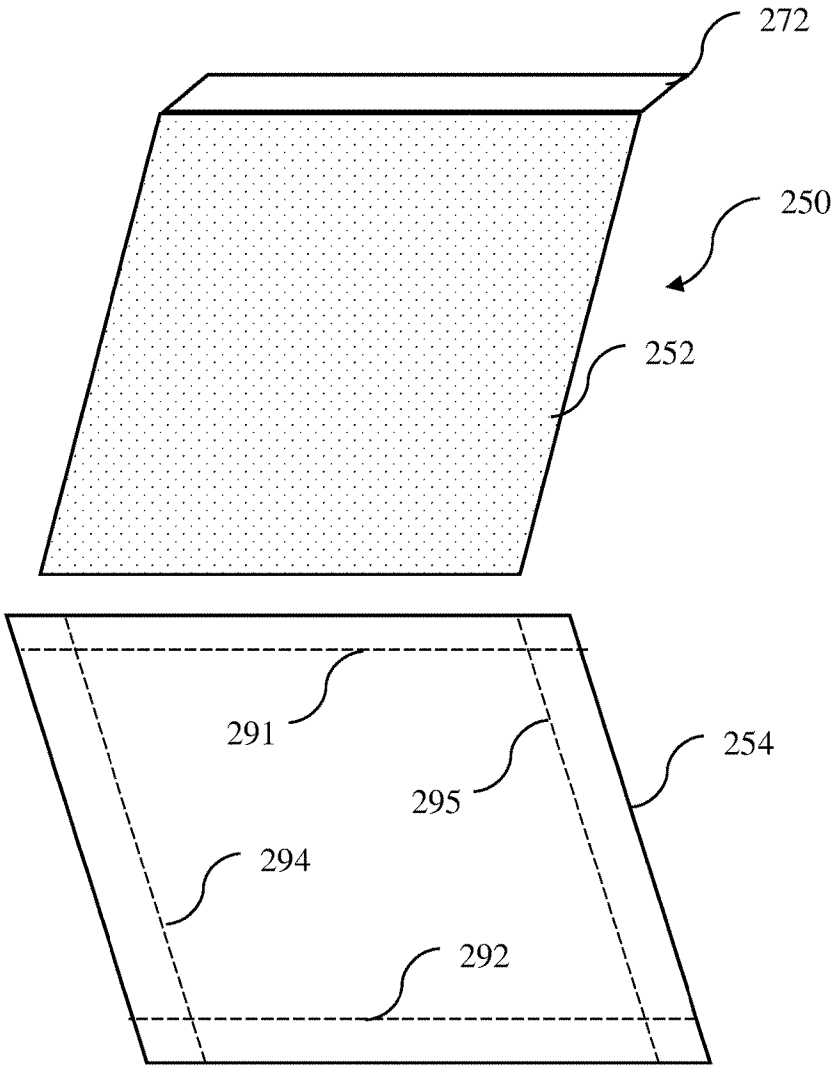
FIG. 2D is a front perspective view of the second embodiment of a system for addition to a box for transporting hot food, shown in a partially folded orientation, according to an example embodiment.

FIG. 2C is a front view of a second embodiment of an insertable paper system 250 for addition to a box 105 for transporting food, the system comprising two separate sheets of paper 252, 254. Whereas the embodiment of FIGS. 2A-2B show one single sheet, the embodiment of FIGS. 2C-2D show a set comprising two separate sheets—a top sheet and a bottom sheet. The top sheet has a length and a width equal to the length and the width of an interior of the box 105 (such as 18 inches by 18 inches), such that the top sheet 252 fits within the interior of the box without being folded. The bottom sheet 254 having a length and a width that are both at least half an inch longer than the length and the width of the interior of the box 105 (such as 18.5 inches by 18.5 inches), such that when the bottom sheet is placed within the interior of the box, edges of the bottom sheet are configured to extend upwards along sides of the interior of the box. Notice that the length and the width of the bottom sheet are longer than the length and the width of the top sheet.

A first food-safe laminate (or non-laminate) coating is deposited on an interior surface 262 of the top sheet 252, wherein said first coating has heat reflecting characteristics. A second food-safe laminate (or non-laminate) coating is deposited on an interior surface 264 of the bottom sheet 254, wherein said second coating has oil-resistant characteristics. A plurality of orifices 263 are located in the top sheet, the plurality of orifices configured for allowing moisture to escape therethrough. The insertable paper system 250 is configured for being removably positioned within the interior of the box 105, such that the food rests on the interior surface 264 of the bottom sheet 254. The system is configured to allow steam and moisture to escape to prevent the food or pizza crust from getting soggy.

The food-safe laminate coatings are comprised of impermeable, nonstick material capable of resisting high temperatures, however, it should be appreciated that other impermeable, nonstick materials may be employed provided that they effectively prevent the top of the pizza from adhering to the system 250. It should be appreciated that attachment devices may be used to secure the system 250 to the interior surface 140 of the top side 110 of the box 105, including backing materials coated with natural adhesives made from organic sources such as vegetable starch, natural resins, or animals, clamps, brackets, slots, or any other suitable method known in the art. Note also that the insertable paper system 250 may be removably coupled to an interior surface 155 of the bottom side 115 of the box 105, according to an example embodiment.

The insertable paper system 250 is configured to maintain the freshly prepared pizza 125 warm during transportation. In operation, the system 250 is positioned inside the box 105 such that when the hot pizza is removed from the oven and placed directly on the box, the pizza 125 is elevated off the interior surface of the bottom side of the box by the width of system 250.

FIG. 2C also shows an optional fold 275 at a top of the top sheet 252, the fold 275 defining a strip 272, which acts as a handle or tab that may be handled by a person wanting to move the device 250. The fold 275 may be a perforated fold. The strip may have the same width as the top sheet but have a height (such as ½ to 1 inch) that is much smaller than the top sheet, hence referring to 272 as a strip. The strip may not include the orifices located in the top sheet.

FIG. 2D is a front perspective view of the second embodiment of the insertable paper system 250 for addition to a box for transporting hot food, shown in a partially folded orientation, according to an example embodiment. FIG. 2D shows an embodiment wherein the bottom sheet 254 includes a plurality of perforations, scoring or pre-folded elements along the sides of the bottom sheet. Scoring 291 is a straight line that runs parallel to the top side of the bottom sheet while scoring 292 is a straight line that runs parallel to the bottom side of bottom sheet. Scoring 294 is a straight line that runs parallel to the left side of the bottom sheet while scoring 295 is a straight line that runs parallel to the right side of bottom sheet. The purpose of the plurality of perforations, scoring or pre-folded elements along the sides of the bottom sheet is to allow for the easy folding or turning of the bottom sheet when it is placed in the interior surface 155 of the bottom side 115 of the box 105, according to an example embodiment (as shown in FIGS. 3-4 below). Scoring refers to the process of making a crease in paper so it will fold easier. A score is a ridge that is indented into the paper where the fold line will occur. This indentation is made such that it compresses the paper fibers to create a hinge-like area. This "hinge" is what allows for smoother folding. Scoring also helps improve the appearance of the fold because it provides a consistent guideline as well as reduces the potential for the paper to buckle or crack. In addition, scored paper is less likely to cause harm to toner-type inks or thicker clear coats during the folding operation.

Figure 2E:
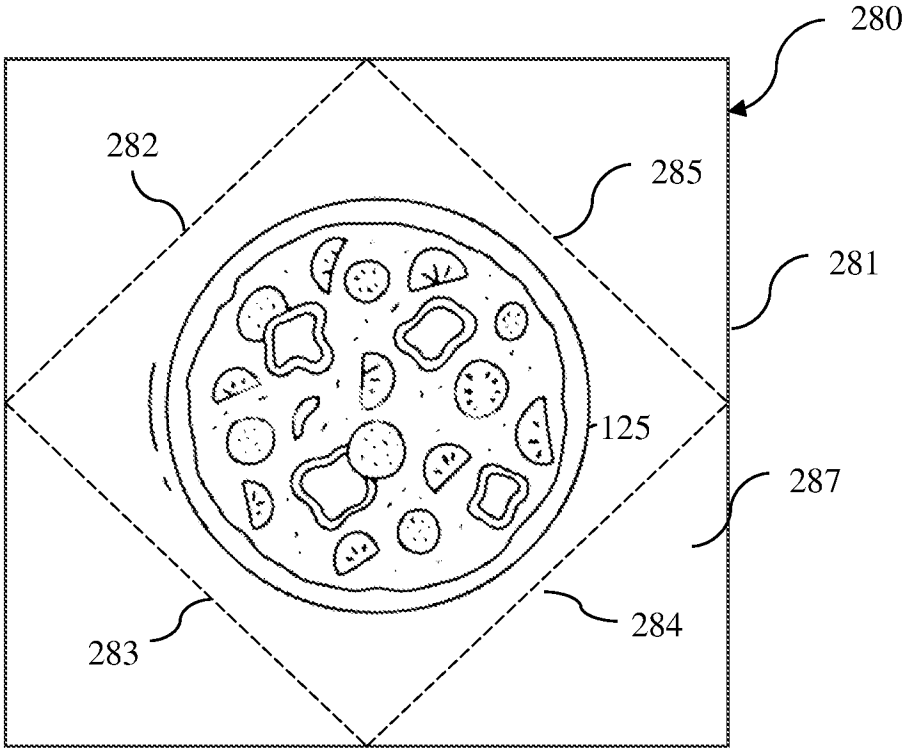
FIG. 2E is a top view of a third embodiment of a system for addition to a box for transporting hot food, shown in an unfolded orientation, according to an example embodiment.
Figure 2F:
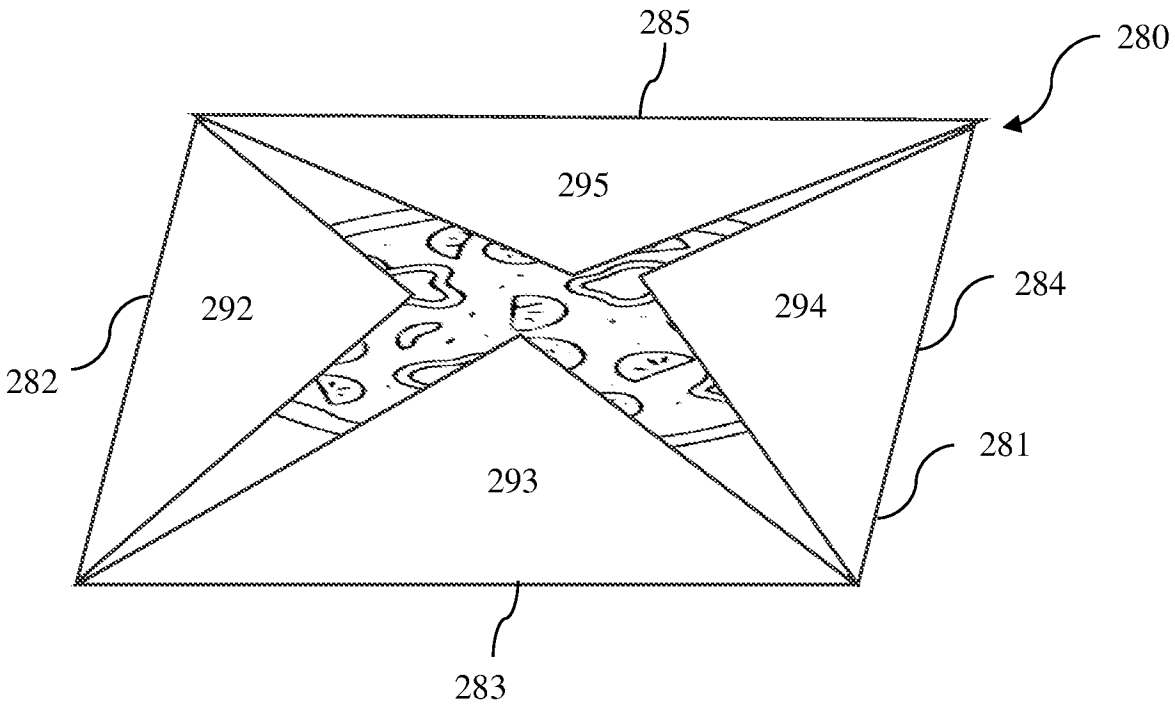
FIG. 2F is a top perspective view of the third embodiment of a system for addition to a box for transporting hot food, shown in a partially folded orientation, according to an example embodiment.
Figure 2G:
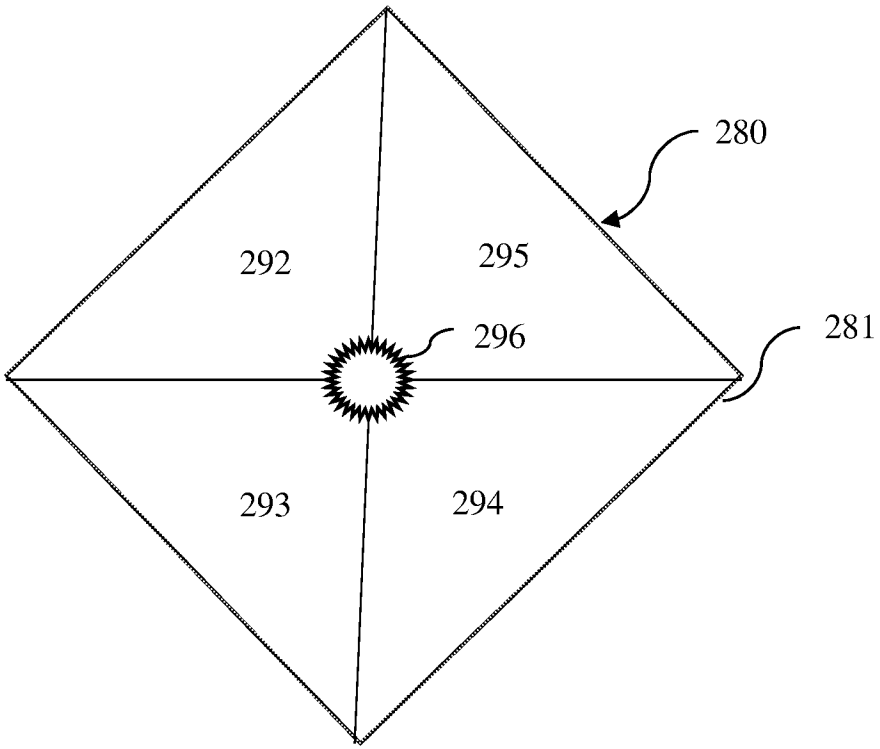
FIG. 2G is a top perspective view of the third embodiment of a system for addition to a box for transporting hot food, shown in a fully folded orientation, according to an example embodiment.

FIG. 2E is a top view of a third embodiment of a system 280 for addition to a box for transporting hot food, shown in an open and unfolded orientation, while FIG. 2F shows the system 280 in a partially folded orientation and FIG. 2G shows the system 280 in a fully folded orientation.

FIG. 2E shows the system comprises a sheet of paper 281 having a diagonal fold line 282 that extends from a midpoint of the top of the sheet to a midpoint of a left side of the sheet, a diagonal fold line 285 that extends from a midpoint of the top of the sheet to a midpoint of a right side of the sheet, a diagonal fold line 283 that extends from a midpoint of the bottom of the sheet to a midpoint of a left side of the sheet, and a diagonal fold line 284 that extends from a midpoint of the bottom of the sheet to a midpoint of a right side of the sheet. The folds 282, 283, 284, 285 make a substantial diamond shape in the sheet 281. Each of the four folds defines a corresponding flap being a portion of the sheet configured to be folded towards the center of the sheet, as shown in FIGS. 2F and 2G. Each fold may be a fold line that may be scored, pre-folded or marked/printed.

In one embodiment, the sheet of paper 281 has a length equal to, or closely equal to, $2\sqrt{½}$ (or approximately 1.4142) times the length of an interior of the box, and the sheet of paper 281 has a width equal to equal to, or closely equal to, $2\sqrt{(½)}$ (or approximately 1.4142) times the width of the interior of the box. In another embodiment, the sheet of paper 281 has a length equal to about one and a half times the length of an interior of the box, and the sheet of paper has a width equal to about one and a half times the width of the interior of the box.

The sheet 281 may have coatings and characteristics as specified for sheets 202, 204, 252, 254 above. The insertable paper system 280 is configured for being removably positioned within the interior of the box 105, such that the food 125 rests on the upward facing surface 287 of the sheet 281. The system is configured to allow steam and moisture to escape to prevent the food or pizza crust from getting soggy. It should be appreciated that attachment devices may be used to secure the system 280 (in a removable manner) to the interior surface 155 of the bottom side 115 of the box 105, according to an example embodiment. The insertable paper system 280 is configured to maintain the freshly prepared pizza 125 warm during transportation. In operation, the system 280 is positioned inside the box 105 such that when the hot pizza is removed from the oven and placed directly in the box, the pizza 125 is elevated off the interior surface of the bottom side of the box by the width of system 280.

FIG. 2F shows the flap 295 has begun to be folded about fold line 285, the flap 294 has begun to be folded about fold line 284, the flap 293 has begun to be folded about fold line 283, and the flap 292 has begun to be folded about fold line 282. Each flap is folded towards a center of the sheet 280, so as to completely cover the pizza 125.

FIG. 2G shows the flap 295 has been fully folded about fold line 285, the flap 294 has been fully folded about fold line 284, the flap 293 has been fully folded about fold line 283, and the flap 292 has been fully folded about fold line 282, such that the pizza 125 has been entirely covered (both top and bottom) by the sheet 281 and it is no longer visible. A sticker 296 holds the flaps 292, 293, 294, 295 together at the center of the device where the flaps meet. The sticker may include adhesive on its rear surface. The sheet 281 has a length and a width such that when the sheet 281 is fully folded about the fold lines, as shown in FIG. 2G, it fits securely within the interior box without being obstructed by the edges of the interior of the box.

Figure 3A:
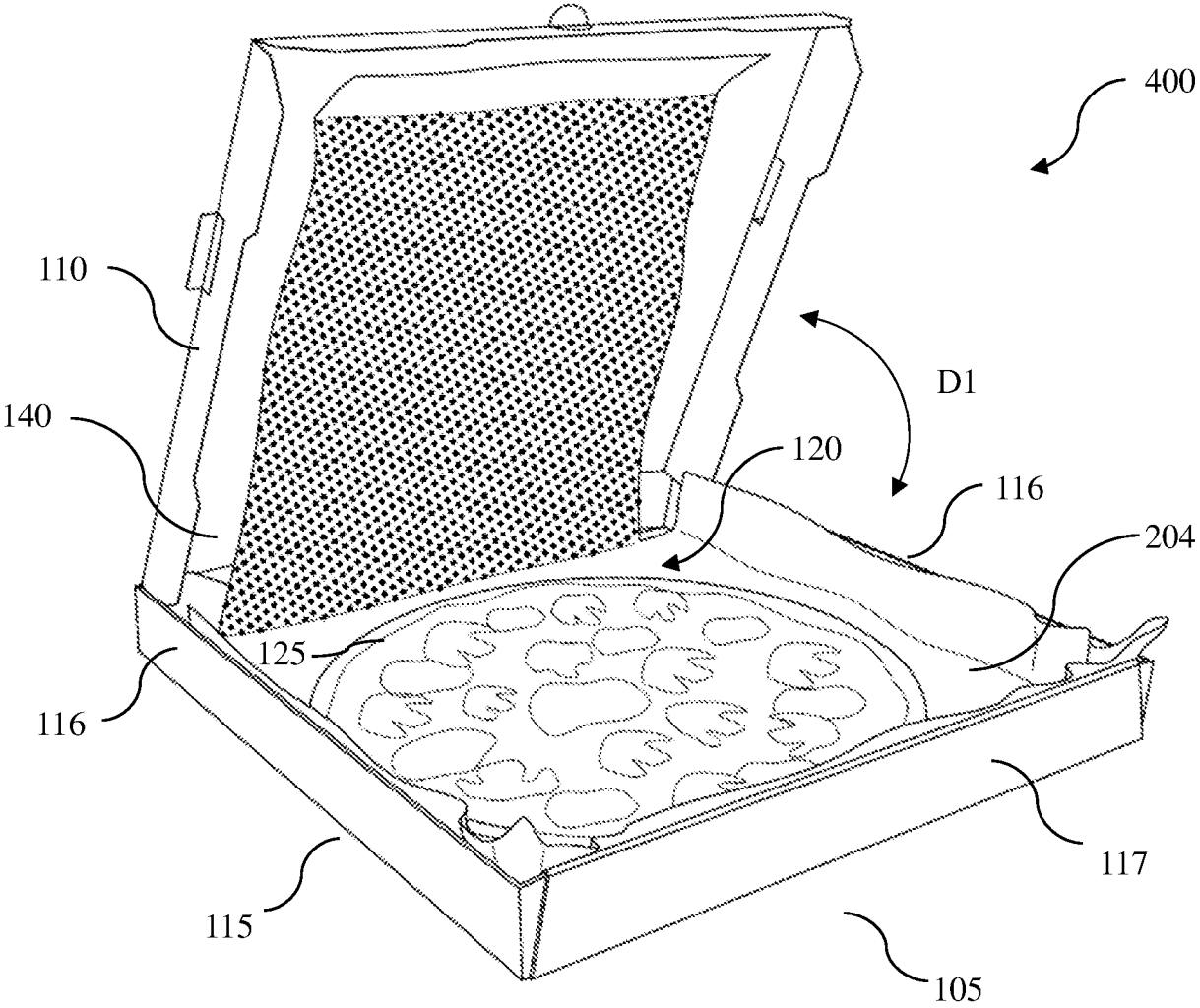
FIG. 3A is a front perspective view of the first embodiment of a system for transporting hot food, including a box and an insertable paper system, according to an example embodiment.
Figure 4:
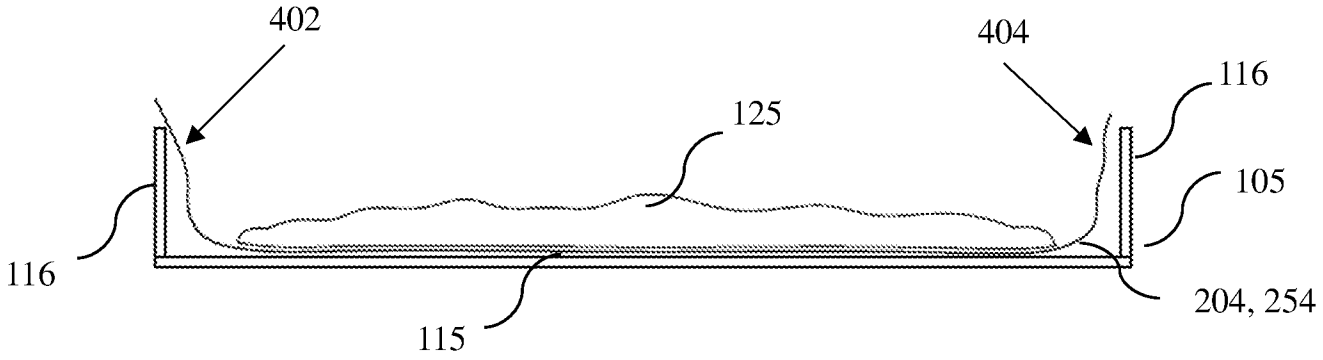
FIG. 4 is a cross sectional view of an embodiment of the system for transporting hot food, including a box and an insertable paper system, according to an example embodiment.

FIG. 3A is a front perspective view of a system 400 for transporting hot food, including a box 105 and an insertable paper system 200, according to the first embodiment shown in FIGS. 2A, 2B. The system 400 includes the box 105 of FIG. 1 having a top side 110 and a bottom side 115. The top side 110 of the box defines a first substantial planar surface and the bottom side 115 of the box defines a second substantial planar surface. The bottom side 115 of the box is hingedly attached to the box such that the top side 110 of the box may pivot between an open position and a closed position (in the direction of double arrowed line D1) to allow access to an interior volume 120 of the box 105. The interior volume 120 of the box 105 is formed by two opposing sidewalls 116 and two opposing end walls 117 on the bottom side of the box. The interior volume 120 of the box is configured to provide sufficient area to store at least one food item.

The pizza 125 sits on top of the interior surface 214 of the bottom sheet 204, wherein said bottom sheet has a second coating that has oil-resistant characteristics. A plurality of orifices 213 are located in the top sheet, the plurality of orifices configured for allowing moisture from the pizza to escape therethrough. In one embodiment, the plurality of orifices 213 may be slits, holes, perforations, cuts, cutouts, of the like. The insertable paper system 200 is configured for being removably positioned within the interior of the box 105, such that the pizza rests on the interior surface 214 of the bottom sheet 204. The system is configured to allow steam and moisture to escape to prevent the food or pizza crust from getting soggy.

FIG. 3A shows that the bottom sheet 204 has a length and a width that are both longer (at least half an inch longer) than the length and the width of the interior surface 155 of the bottom side 115 of the box 105, such that when the bottom sheet is placed within the interior of the box, edges of the bottom sheet are configured to extend upwards along sides of the interior of the box. FIG. 3A shows that the edges of the bottom sheet 204 travel upwards along the two opposing sidewalls 116 and two opposing end walls 117 on the bottom side of the box. FIG. 3A show that the edges of the bottom sheet 204 travel upwards around the entire perimeter of the box, so as to create a bowl-like shape that is able to hold liquid such as grease, oil, and the like. This prevents the pizza oil from touching or soaking the box, which allows the box to be recycled, since pizza boxes soiled with oil are not recyclable. The embodiment shown in FIG. 3A can also be used with the second embodiment 250 of the system for transporting hot food, as shown in FIGS. 2C, 2D.

In one embodiment, the bottom sheet 254 includes a plurality of perforations, scoring or pre-folded elements along the sides of the bottom sheet. Scoring 291, 292, 294, 295 (see FIG. 2D) comprise a plurality of perforations, scoring or pre-folded elements along the sides of the bottom sheet is to allow for the easy folding or turning of the bottom sheet when it is placed in the interior surface 155 of the bottom side 115 of the box 105, as shown in FIG. 3A. That is, when the bottom sheet is placed within the interior of the box, the bottom sheet folds at the plurality of perforations, scoring or pre-folded elements, such that the edges 402, 404 of the bottom sheet extend upwards along sides of the interior of the box.

Figure 3B:
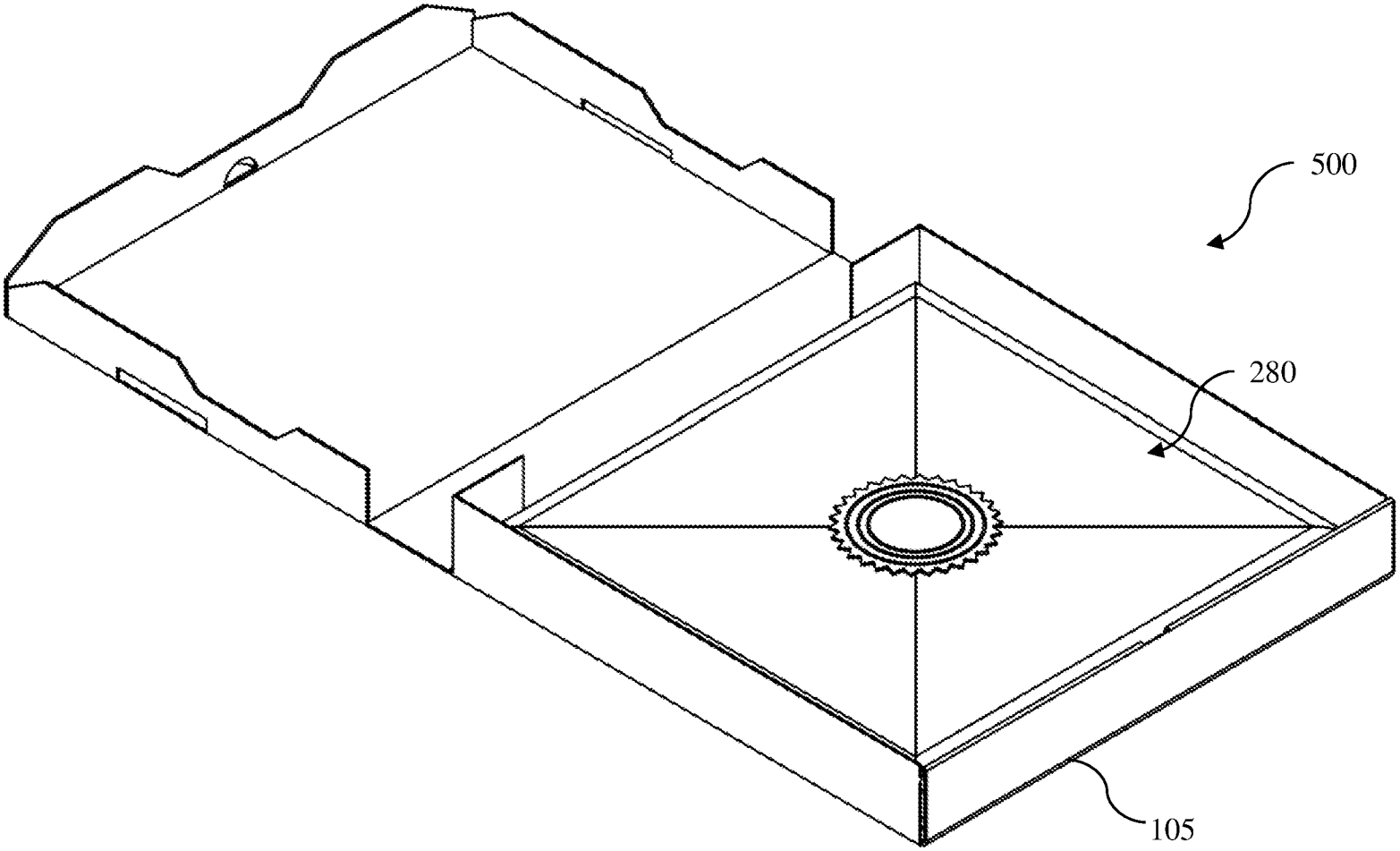
FIG. 3B is a top perspective view of the third embodiment of a system for transporting hot food, including a box and an insertable paper system, according to an example embodiment.
Figure 3C:
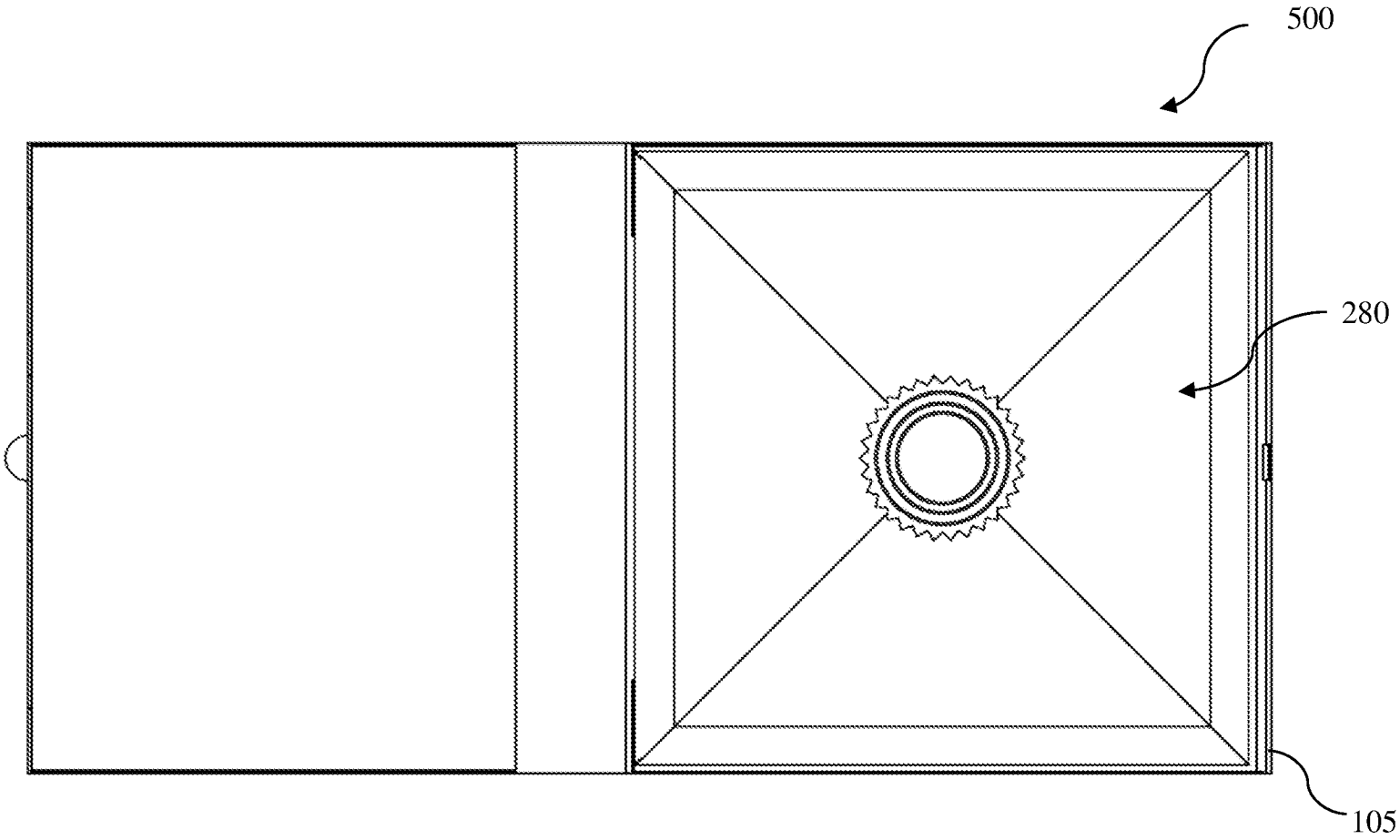
FIG. 3C is a top view of the third embodiment of a system for transporting hot food, including a box and an insertable paper system, according to an example embodiment.
Figure 3D:
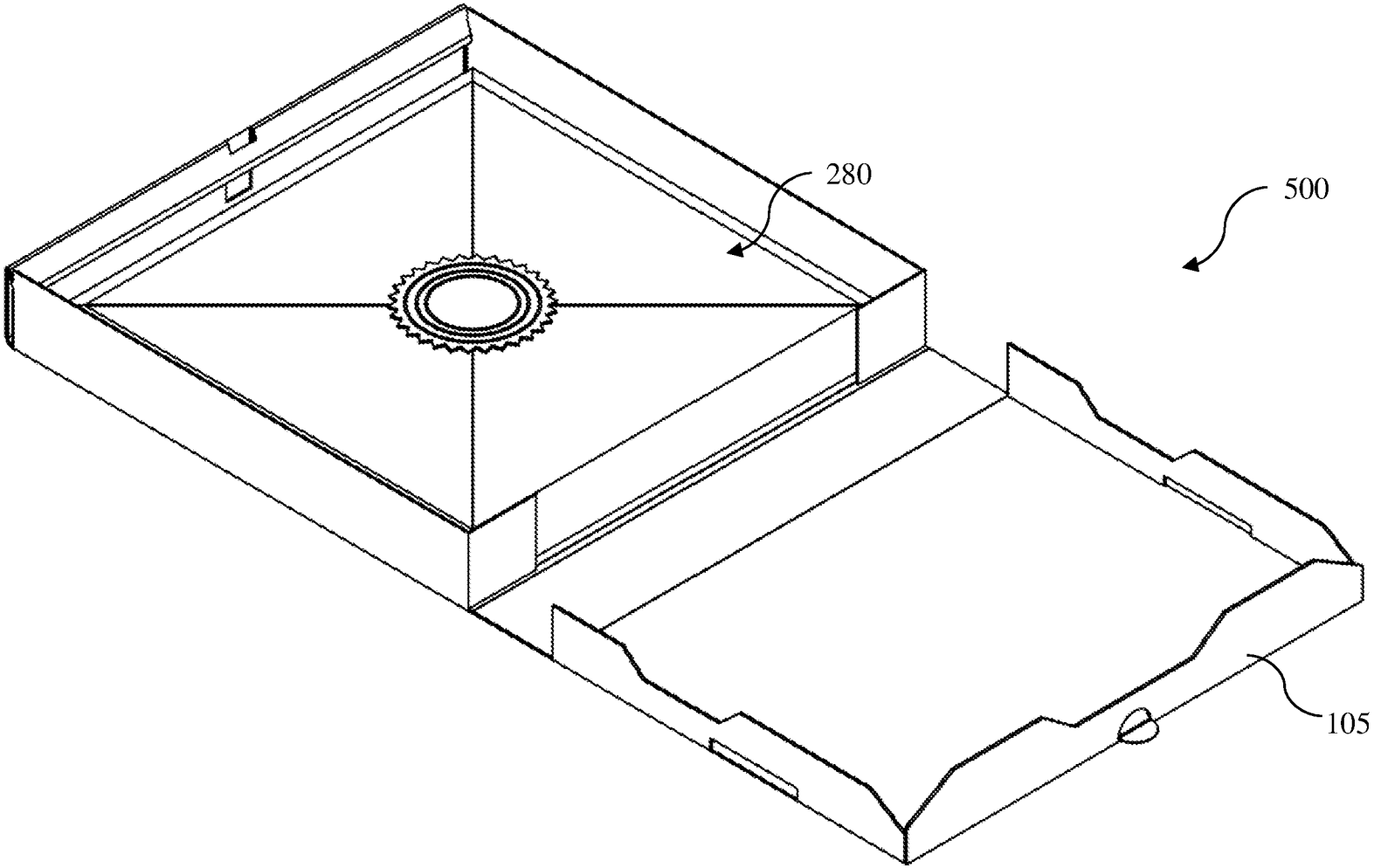
FIG. 3D is another top perspective view of the third embodiment of a system for transporting hot food, including a box and an insertable paper system, according to an example embodiment.
Figure 3E:
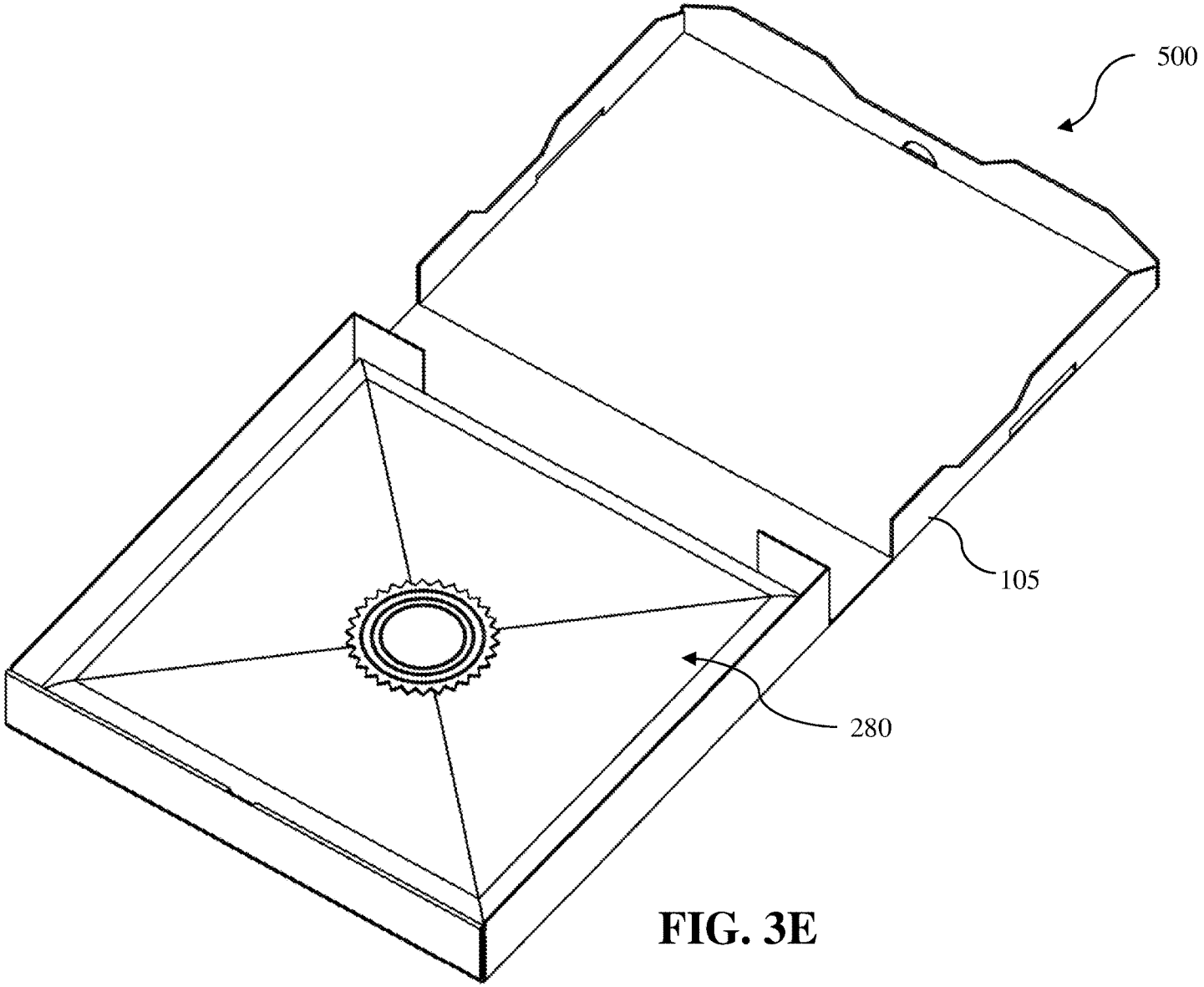
FIG. 3E is another top perspective view of the third embodiment of a system for transporting hot food, including a box and an insertable paper system, according to an example embodiment.

FIG. 3B is a top perspective view of the third embodiment of a system 500 for transporting hot food, according to an example embodiment. FIG. 3C is a top view of the system 500, while FIG. 3D and FIG. 3E show additional top perspective views of the system 500. Said figures show the system 280 in a fully folded orientation and placed within the pizza box 105. In a fully folded orientation, the pizza 125 has been entirely covered (both top and bottom) by the sheet 281 and the pizza is no longer visible. A sticker holds the flaps together at the center of the device where the flaps meet. The sheet of system 280 has a length and a width such that when the sheet is fully folded about the fold lines in the fully folded orientation, it fits securely within the interior box without being obstructed by the edges of the interior of the box.

FIG. 4 is a cross sectional view of the embodiments of the system 400 for transporting hot food, including a box and an insertable paper system, according to an example embodiment. FIG. 4 shows that the bottom sheet 204 or 254 has a length and a width that are both longer (at least half an inch longer) than the length and the width of the interior surface 155 of the bottom side 115 of the box 105, such that when the bottom sheet is placed within the interior of the box, edges 402, 404 of the bottom sheet are configured to extend upwards along sides of the interior of the box. FIG. 4 show that the edges 402, 404 of the bottom sheet travel upwards along the two opposing sidewalls 116 on the bottom side of the box 105. FIG. 4 show that the edges of the bottom sheet 204, 254 travel upwards around the entire perimeter of the box, so as to create a bowl-like shape that is able to hold liquid such as grease, oil, and the like.

In one embodiment, the bottom sheet 254 includes a plurality of perforations, scoring or pre-folded elements along the sides of the bottom sheet that allow for the easy folding or turning of the bottom sheet when it is placed in the interior surface 155 of the bottom side 115 of the box 105, as shown in FIG. 4. That is, when the bottom sheet is placed within the interior of the box, the bottom sheet folds at the plurality of perforations, scoring or pre-folded elements, such that the edges 402, 404 of the bottom sheet extend upwards along sides of the interior of the box.

Figure 5:
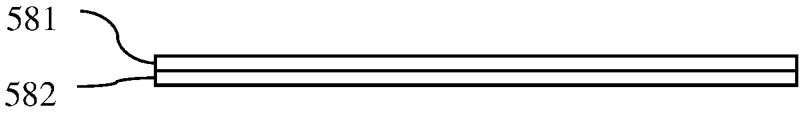
FIG. 5 is a cross sectional view of an embodiment of the insertable paper system, according to an example embodiment.

FIG. 5 is a cross sectional view of the embodiments of the insertable paper system 200, 250, according to an example embodiment. The sheet(s) of the system 200, 250 may be composed of a first layer 582 of paper, wherein the first layer is configured for being removably coupled to an interior surface of the box. In one embodiment, the sheet of the system 200, 250 is not coupled to an interior surface of the box but rather simply lie(s) on top of, or under, the food in the box, set in place using solely gravity and friction. The second layer 581 may include printed material configured for advertising.

The first layer may be composed of paper, such as cotton paper, synthetic paper, parchment paper, baking paper, liners or bakery release paper is cellulose-based paper that has been treated or coated to make it non-stick. Said paper may have a certain pliability and have a reflectivity coating to reflect heat. Alternative to parchment paper is wax paper, which is paper that has been made moisture-proof through the application of wax. Alternative to parchment paper is acetate paper, which is a transparent material that is made by reacting cellulose with acetic acid in the presence of sulfuric acid. The first layer may be food and liquid impermeable, such that food and liquid from food (such as oil and water) does not pass through said first layer.

By utilizing vented holes or orifices for escaping moisture, the claimed embodiments address the issues associated with transporting pizzas and food items safely—heat loss, excessive moisture, and damage to the box from oil. The claimed embodiments allow heat to be redirected back into the food, and not out through the box edges. The venting orifices or holes are designed to allow moisture to escape away from the food and be absorbed into the insulated top sheet. The bottom sheet may not be vented, keeping the crust of a pizza, for example, hot and crispy by locking in the heat from escaping through the cardboard of the box and blocking oils or sauces from entering into the cardboard of the box, which preserves the box for recycling.

Tests performed using the claimed embodiments show that food can be kept at least at the recommended standard of 140 degrees for extended periods of time, using the claimed box system. Tests performed used the claimed embodiments show that food can also be kept at a 10-12-degree higher temperature of 152-154 for extended periods of time. Systems that do not use the claimed embodiment result in food temperatures well below the 140-degree mark (from 95 to 120 degrees), inviting food borne bacterial growth.

Paper with vented holes or orifices for escaping moisture allows moisture to exit. Without these vented holes, condensation cannot exit freely enough. Without these vented holes, the adhesion effect applies, and droplets of rain develop and falls back into the food in the box. Venting must occur equally and evenly related to the top insert. The vented holes may be standard holes, perforated holes, slits, round holes, square holes, and the like.

The present invention provides outstanding results achieving 30 minutes of travel time keeping pizza hot, safe, well above temperatures that eliminates bacterial growth. The present invention is a coated sheet with a plurality of small slits or pinholes that allows moisture to escape while simultaneously reflecting heat back into the pizza. The bottom portion is a solid coated sheet that effectively blocks oils and aligns the pizza perfectly in place. The size and shape of the present invention may be oversized by ¼"-¾"+ to create an oil containment edge within the bottom insert. The built-in edge trap holds spillages of cheesy residue and oils on the inside edges of the insert blocking any leakage that ruins the pizza box for recycling. For example, for a small 10"×10" pizza, the present invention would be slightly oversized by ¼"-¾ " to allow for the confinement edge to curl upward to confine the hot oils from escaping past the insert. The curled edges maintain that the pizza stays centered inside the box.

A single fold/or a double folded insert positions the pizza as a nesting pouch onto the non-porous insert. The pizza will not shift around and bump into the edges of the pizza box. Thus, making the entire pizza box fully recyclable.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A system for addition to a box for transporting food, the system comprising:

a) a sheet of paper having a length equal to about one and a half times the length of an interior of the box, and the sheet of paper having a width equal to about one and a half times the width of the interior of the box;

b) the sheet further including four folds defining a diamond shape in the sheet, wherein each of the four folds defines a corresponding flap being a portion of the sheet configured to be folded towards a center of the sheet;

c) such that when food is placed on the sheet, the sheet is folded according to the four folds defined in the sheet, and the sheet is placed within the interior of the box, the sheet completely covers the food and the sheet fits securely within the interior of the box;

d) a first food-safe coating on the sheet, wherein said first coating has heat reflecting characteristics;

e) a second food-safe coating on the sheet, wherein said second coating has oil-resistant characteristics and heat reflecting characteristics;

f) a plurality of orifices in the sheet, the plurality of orifices configured for allowing moisture to escape therethrough; and g) wherein the sheet is configured for being removably positioned within the interior of the box, such that the food rests on the sheet.

2. The system of claim 1, wherein the first food-safe coating spans an entirety of a surface of the sheet.

3. The system of claim 2, wherein the first food-safe coating has non-stick characteristics.

4. The system of claim 3, wherein the second food-safe coating spans an entirety of the surface of the sheet.

5. The system of claim 4, wherein the second food-safe coating has non-stick characteristics.

6. The system of claim 5, wherein a top surface of the sheet includes printed material configured for advertising.

7. The system of claim 6, wherein a bottom surface of the sheet includes printed material configured for advertising.

8. The system of claim 7, wherein each of the four folds comprises a scored line.

9. The system of claim 8, wherein each of the four folds comprises a perforation.

10. The system of claim 9, further comprising a sticker that is placed on the flaps at the center of the sheet when the sheet is folded according to the four folds defined in the sheet, and the flaps are folded towards a center of the sheet.

11. A system for transporting food, the system comprising a box having an interior including a length and width, and a) a sheet of paper having a length equal to about one and a half times the length of the interior of the box, and the sheet of paper having a width equal to about one and a half times the width of the interior of the box;

b) the sheet further including four folds defining a diamond shape in the sheet, wherein each of the four folds defines a corresponding flap being a portion of the sheet configured to be folded towards a center of the sheet;

c) such that when food is placed on the sheet, the sheet is folded according to the four folds defined in the sheet, and the sheet is placed within the interior of the box, the sheet completely covers the food and the sheet fits securely within the interior of the box;

d) a first food-safe coating on the sheet, wherein said first coating has heat reflecting characteristics;

e) a second food-safe coating on the sheet, wherein said second coating has oil-resistant characteristics and heat reflecting characteristics;

f) a plurality of orifices in the sheet, the plurality of orifices configured for allowing moisture to escape therethrough; and g) wherein the sheet is configured for being removably positioned within the interior of the box, such that the food rests on the sheet.

12. The system of claim 11, wherein the first food-safe coating spans an entirety of a surface of the sheet.

13. The system of claim 12, wherein the first food-safe coating has non-stick characteristics.

14. The system of claim 13, wherein the second food-safe coating spans an entirety of the surface of the sheet.

15. The system of claim 14, wherein the second food-safe coating has non-stick characteristics.

16. The system of claim 15, wherein a top surface of the sheet includes printed material configured for advertising.

17. The system of claim 16, wherein a bottom surface of the sheet includes printed material configured for advertising.

18. The system of claim 17, wherein each of the four folds comprises a scored line.

19. The system of claim 18, wherein each of the four folds comprises a perforation.

20. The system of claim 19, further comprising a sticker that is placed on the flaps at the center of the sheet when the sheet is folded according to the four folds defined in the sheet, and the flaps are folded towards a center of the sheet.

* * * * *